US007017439B2

(12) United States Patent
Schunke et al.

(10) Patent No.: US 7,017,439 B2
(45) Date of Patent: Mar. 28, 2006

(54) ADJUSTING DEVICE

(75) Inventors: Kurt Schunke, Minden (DE); Bernd Buchholz, Rahden (DE); Dieter Palm, Werther (DE)

(73) Assignee: Megdal Associates, LLC, Pittsburgh, PA (US)

( * ) Notice: Subject to any disclaimer, the term of this patent is extended or adjusted under 35 U.S.C. 154(b) by 0 days.

(21) Appl. No.: 09/727,109

(22) Filed: Nov. 30, 2000

(65) Prior Publication Data

US 2001/0013715 A1 Aug. 16, 2001

(30) Foreign Application Priority Data

Nov. 30, 1999 (DE) ..... 299 20 996 U

(51) Int. Cl.
*G05G 1/00* (2006.01)

(52) U.S. Cl. ..... 74/469; 297/423.26; 297/423.23

(58) Field of Classification Search ..... 74/469, 74/89; 297/423.26, 423.23, 423.3, 69, 70, 297/330

See application file for complete search history.

(56) References Cited

U.S. PATENT DOCUMENTS

| | | | | | |
|---|---|---|---|---|---|
| 3,635,461 | A | * | 1/1972 | Bellucci et al. | 5/616 |
| 4,104,749 | A | * | 8/1978 | Grundler | 5/616 |
| 4,120,057 | A | | 10/1978 | Neumann | |
| 4,470,318 | A | * | 9/1984 | Cremer et al. | 74/353 |
| 4,488,699 | A | * | 12/1984 | Chevalier | 248/396 |
| 4,696,512 | A | | 9/1987 | Burnett et al. | |
| 4,786,107 | A | * | 11/1988 | Crockett | 297/330 |
| 5,061,010 | A | | 10/1991 | LaPointe | |
| 5,072,463 | A | * | 12/1991 | Willis | 5/618 |
| 5,123,622 | A | * | 6/1992 | Matsumoto et al. | 248/421 |
| 5,155,496 | A | * | 10/1992 | Suga | 343/903 |
| 5,326,153 | A | | 7/1994 | Muffi | |
| 5,419,611 | A | | 5/1995 | Cook | |
| 5,478,133 | A | | 12/1995 | Tidwell, Jr. | |
| 5,568,661 | A | | 10/1996 | Bathrick et al. | |
| 5,640,730 | A | * | 6/1997 | Godette | 5/618 |
| 5,651,580 | A | | 7/1997 | LaPointe et al. | |
| 5,668,692 | A | * | 9/1997 | Rodgers et al. | 361/93.4 |
| 5,730,494 | A | * | 3/1998 | LaPointe et al. | 297/330 |
| 5,787,528 | A | | 8/1998 | Antinori | |
| 5,927,144 | A | * | 7/1999 | Koch | 74/89.36 |

FOREIGN PATENT DOCUMENTS

| | | |
|---|---|---|
| DE | 93 18 082.9 | 4/1994 |
| DE | 297 10 298 | 8/1997 |
| DE | 196 47 544 | 4/1998 |

* cited by examiner

*Primary Examiner*—David Fenstermacher
(74) *Attorney, Agent, or Firm*—Leland Schermer & Associates, P.C.

(57) ABSTRACT

An adjustment device includes a lifting mechanism having a lifting arm articulated to a component of a stationary supporting structure for moving the component between two end positions. A rotary drive mechanism has an output member which is linked to the lifting arm. In order to completely, or at least partially, absorb a load moment exerted during movement of the component, at least one stationary support element is associated to the rotary drive mechanism.

3 Claims, 9 Drawing Sheets

19
24
26
25
12
21
20
15
26
11

20
15
12
27
16
14
11
15
26
20

ADJUSTING DEVICE

CROSS-REFERENCES TO RELATED APPLICATIONS

This application claims the priority of German Patent Application Serial No. 299 20 996.2, filed Nov. 30, 1999, the subject matter of which is incorporated herein by reference.

BACKGROUND OF THE INVENTION

The present invention relates, in general, to an adjusting device, and more particularly to an adjusting device of a type including a lifting mechanism and a rotary drive having an output member coupled to a lifting arm of the lifting mechanism, with the lifting arm articulated to a component of a stationary supporting structure for movement of the component between two end positions.

An adjusting device of this type can be configured for a wide variety of applications. Unlike the rotary drive which normally remains unchanged regardless for which application it is used, the lifting mechanism is configured to suit the application at hand. The adjusting device, involved here, is in particular suitable for applications in which the stationary supporting structure is made of a frame or configured as a frame, and the component being moved is also of frame-like design and swingably mounted to the supporting structure. The rotary drive is typically a dc gear motor operated with a safety voltage and at an output speed which is fairly small compared to the speed of the rotor of the dc motor.

The adjusting device is especially used for so-called mass products and thus should be as inexpensive as possible.

Normally, the rotary drive is secured by a mounting to the stationary parts. This mounting is positioned at an offset to the moving output member of the rotary drive so that the output force of the rotary drive applies a moment upon the mounting. The mounting should therefore be dimensioned accordingly; however the parts of the supporting structure fail to provide the required stability.

SUMMARY OF THE INVENTION

It is thus an object of the present invention to provide an improved adjusting device, obviating the afore-stated drawbacks.

In particular, it is an object of the present invention to provide an improved adjusting device with a lifting mechanism which can be suited to the type and operation of the component being moved and is easy and inexpensive to couple to the output member of the rotary drive.

These objects, and others which will become apparent hereinafter, are attained in accordance with the present invention by providing a lifting mechanism having a lifting arm operatively connected to a component of a stationary supporting structure for moving the component between two end positions, a rotary drive mechanism having an output member linked to the lifting arm, and at least one stationary support element, associated to the rotary drive mechanism, for partially or completely absorbing a load moment exerted during movement of the component.

In accordance with the present invention, the moment caused by the swinging motion can be absorbed at least partially by the stationary support element so that the mounting, required for attachment of the rotary drive, is not or only minimally exposed to stress. This is especially of advantage when the adjusting device is used to move the head portion or footrest of a slatted frame as the supporting components are normally suitable only to cope with a normal load but not with additional forces generated by the drives. The moment and the forces can now be diverted advantageously through the housing of the rotary drive, whereby it is suitable to provide each support element as a support beam which extends from one longitudinal side to the other longitudinal side of the supporting structure. In this case, the support beam extends from one side panel to the other side panel. Depending on the application at hand, the support element or support beam may be positioned relative to the rotary drive such that pressure forces are normally diverted away.

According to another embodiment of the present invention, the rotary drive may be positioned between two support elements in the form of support beams. In this case, tensile forces as well as pressure forces may be absorbed by the support beams. Depending on the type of use, the support beams may extend horizontally or also vertically, and may form a guide in particular in vertical disposition. This may be necessary, for example, when incorporating the adjusting device in a seating furniture.

According to another embodiment of the present invention, the housing of the rotary drive may be supported indirectly by the support beam. This can be implemented, for example, by attaching a fork head with aligned bores to the housing of the rotary drive or forming in the housing wall aligned bores, for passage of the support beam through the bores of the fork head or the bores of the housing wall.

A particularly simple and operatively safe connection between the output member of the rotary drive and the lifting arm of the lifting mechanism can be realized by form-fittingly connecting the output member of the rotary drive with the lifting arm of the lifting mechanism. In this way, an adjustment of the lifting arm with respect to the output member of the rotary drive is also avoided.

Suitably, the output member of the rotary drive may be formed by a rotation part with a polygonal bore for snug-fit passage of a crossbar through the bore, whereby the crossbar has ends which are connected to parallel bars of the swingable components or to the lifting arms of the lifting mechanism. In this manner, a coupling between the parallel lifting arms of the lifting mechanism can be implemented in a most simple manner.

The rotary drive is suitably mounted in the area of one longitudinal side of the supporting structure to provide superior accessibility. Advantageously, the crossbar may be attached with one rotary drive distal end to a profiled piece which is arranged at the rotary drive facing side of the one lifting arm which is positioned distal to the rotary drive. In this manner, the assembly is convenient and simplified.

In conventional adjusting devices, the movement between the end positions of the swingable component is restricted by two limit switches, which are mounted within the rotary drive on a strip. Of course, such a configuration is certainly possible also in an adjusting device according to the present invention. However, it is also possible in accordance with another feature of the present invention, to define the end positions of the movable component by at least one stop member which is either provided in the housing of the rotary drive, lifting mechanism or supporting structure. Preferred is a fixed disposition of the stop member so that a moving part of the rotary drive or of the lifting mechanism runs against the stop member in the respective end position. To prevent damage of the drive motor of the rotary drive in the event the motor is not cut immediately when the moving part impacts the stop member, the drive motor has incorporated therein an overload relay in the power supply line for shutting down the motor when a the current exceeds a predetermined value.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
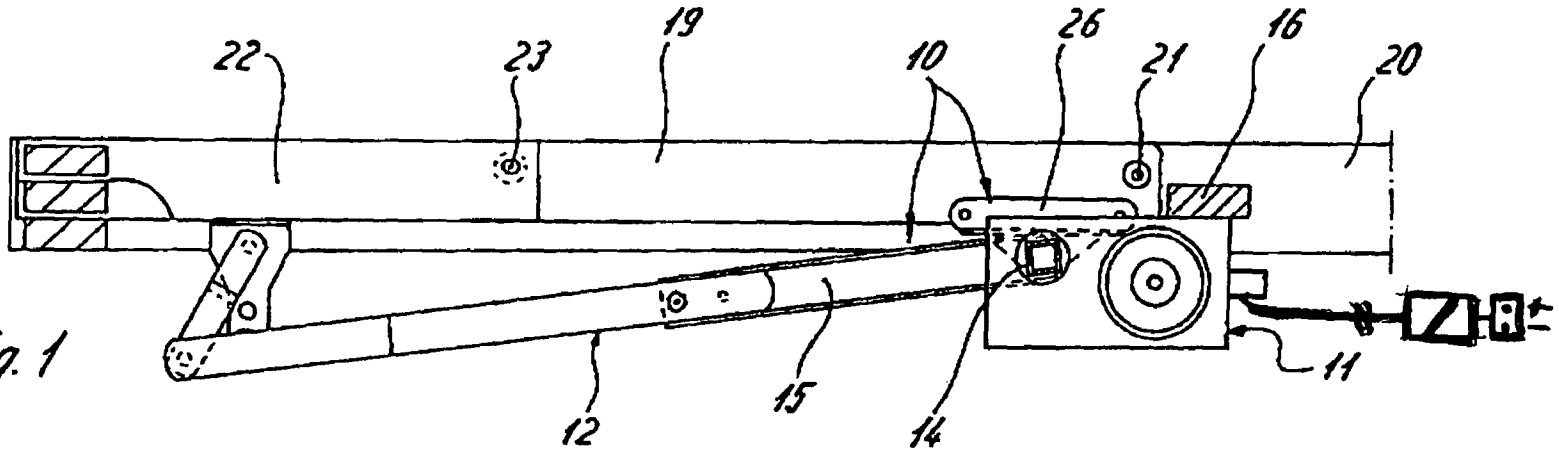
FIG. 1 is a schematic side view of one embodiment of an adjusting device according to the present invention, mounted to an exemplified slatted frame in one end position.

Throughout all the Figures, same or corresponding elements are generally indicated by same reference numerals.

Turning now to the drawing, and in particular to FIG. 1, there is shown a schematic side view of one embodiment of an adjusting device according to the present invention, generally designated by reference numeral 10 and mounted to an exemplified slatted frame, generally designated by reference numeral 1 and including spaced-apart stationary side panels 20 (only one side panel 20 is visible in FIG. 1), a back portion 19 which is swingable mounted to the side panels 20 for rotation about a pivot axis 21, and a head portion 22 which is swingably mounted to the back portion 19 for rotation about a pivot axis 23. The adjusting device 10 includes a rotary drive mechanism, generally designated by reference numeral 11, and a lifting mechanism, generally designated by reference numeral 12. The rotary drive mechanism 11 includes a housing 13 and a dc motor (not shown), which is accommodated in the housing 13 and has an output member with a square bore in which a crossbar 14 in the form of a square tube is snugly fitted. Of course, the square configuration of the bore and complementary square configuration of the crossbar 14 are shown by way of example only, and may certainly be replaced by any other polygonal configuration, without departing from the gist of the present invention.

Mounted in fixed rotative engagement to the crossbar 14 is a lifting arm 15 of the lifting mechanism 12. Persons skilled in the art will understand that the lifting arm 15 is duplicated on the opposite side of the slatted frame 1 for attachment to the crossbar 14 (cf. FIG. 9). In the idle position, shown in FIG. 1, the lifting arm 15 is slanted downwards and is pivotally mounted to a swing link 3, which is coupled with the head portion 22 via a bracket 4.

The housing 13 of the rotary drive mechanism 11 is supported by a support member in the form of a beam 16 which extends parallel to the crossbar 14 and is intended to absorb pressure forces acting on the rotary drive mechanism 11 when the lifting mechanism 12 is lowered. The support beam 16 can be secured in a suitable manner with their ends to the stationary side panels 20 of the slatted frame 1. Persons skilled in the art will understand that the disposition of the support beam 16 is, however, dependent on the application at hand and may differ from the one shown in FIG. 1.

Figure 2:
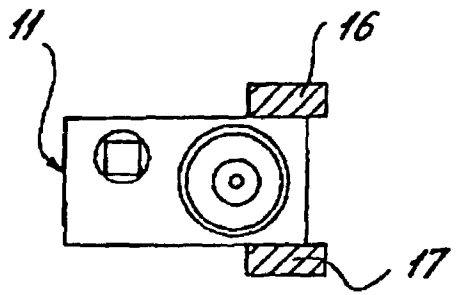
FIG. 2 is a cutaway view of the adjustment device of FIG. 1 showing a variation for support of the rotary drive.

FIG. 2 shows a variation of the adjusting device 10 in which a second support beam 17 is provided in spaced-apart parallel relationship to the support beam 16 for supporting the rotary drive mechanism 11, so that the support beams 16, 17 are able to absorb tensile forces and pressure forces. Although, FIG. 2 shows the support beams 16, 17 in horizontal orientation, it is certainly within the scope of the present invention to position the support beams 16, 17 in a vertical orientation in the event some applications require such a disposition.

Figure 3:
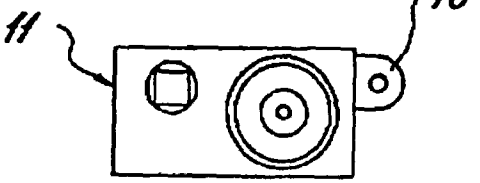
FIG. 3 is a cutaway view of the adjustment device of FIG. 1 showing another variation for support of the rotary drive.

In accordance with another variation, as shown in FIG. 3, the housing 13 of the rotary drive mechanism 11 is provided on the side distal to the output member with a fork head 18 or tab. The fork head 18 has aligned bores 2 for snug-fittingly receiving a support member 16 in the form of a rod. As an alternative, the housing 13 may also be formed with two aligned bores for receiving such a rod. Which configuration of the adjusting device 10 is employed is dictated by the application at hand.

Referring back to FIG. 1, the housing 13 of the rotary drive mechanism 11 is secured to one of the side panels 20 of the slatted frame 1 by a mounting 26, so that the side panel 20 represents the stationary support structure for the adjusting device 10.

Figure 4:
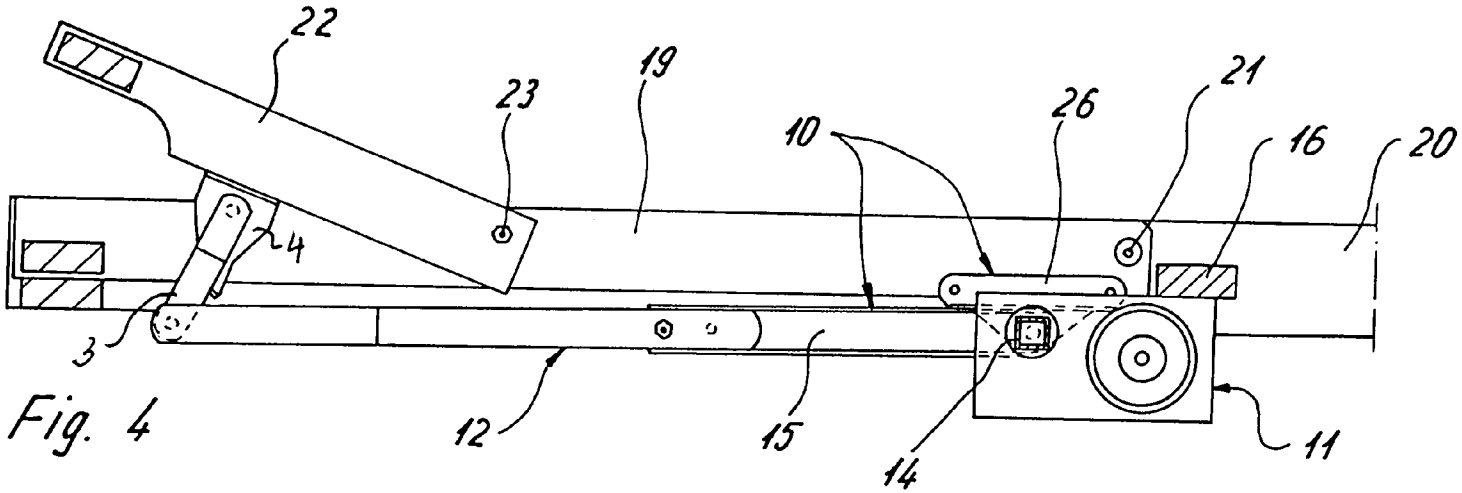
FIG. 4 is a schematic side view of the adjusting device of FIG. 1, showing the slatted frame in an intermediate position.
Figure 5:
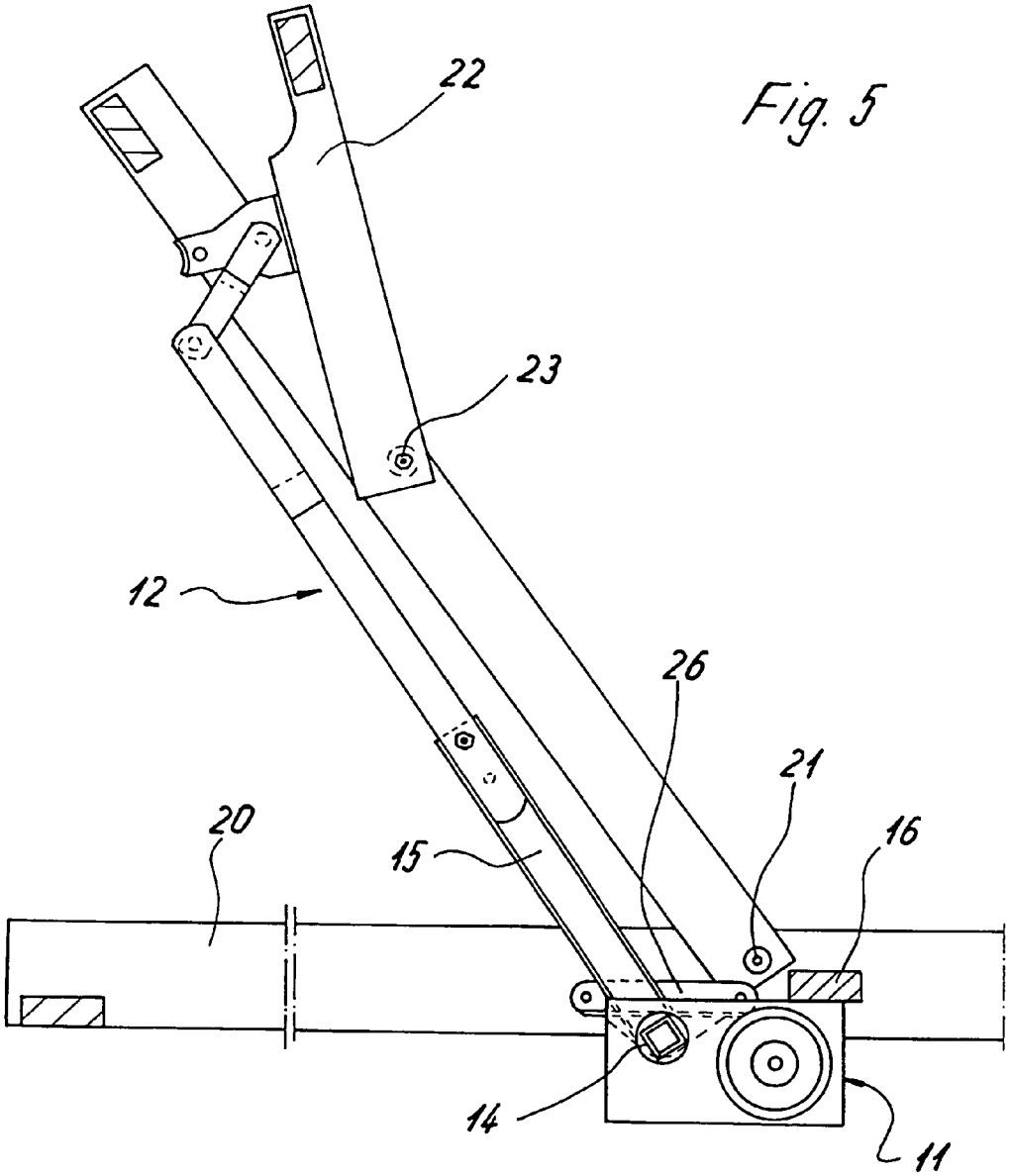
FIG. 5 is a schematic side view of the adjusting device of FIG. 1, showing the slatted frame in the other end position.

When the dc motor of the rotary drive mechanism 11 is activated, the slanted lifting arm 15 is moved into a horizontal disposition to thereby move the head portion 22 via the swing link 3 and bracket 4 into a slanted disposition, as shown in FIG. 4. Upon further swinging of the lifting arm 15 by the dc motor, the head portion 22 conjointly moves the back portion 19 until reaching an end position in which the back portion 19 also assumes a slanted disposition, as shown in FIG. 5. Suitably, this end position is defined by a stationary stop member (not shown here), which may project out from the housing 13 or the mounting 26. Lowering of the back portion 19 and the head portion 22 is implemented through reversing the rotation direction of the dc motor.

Figure 6:
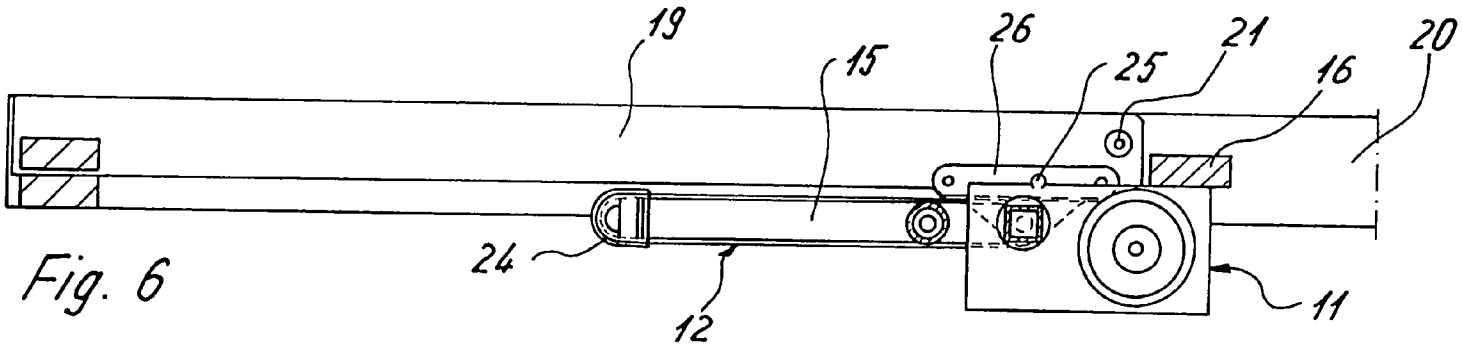
FIG. 6 is a schematic side view of another embodiment of an adjusting device according to the present invention, mounted to an exemplified slatted frame in one end position.

Turning now to FIG. 6, there is shown a schematic side view of another embodiment of an adjusting device 10 according to the present invention, mounted to an exemplified slatted frame 1. Parts corresponding with those in FIG. 1 are denoted by identical reference numerals and not explained again. In this embodiment, the slatted frame 1 is devoid of a head portion so that the lifting mechanism 11 can have a simplified configuration. The swingable lifting arms 15 extend underneath in direct contact with the side panels 20 of the swingable back portion 19. Friction between the lifting arms 15 and the underside of the side panels 20 is reduced through the provision of sliders 24 which are made of suitable material known to the artisan and are attached to the free ends of the lifting arms 15.

Figure 7:
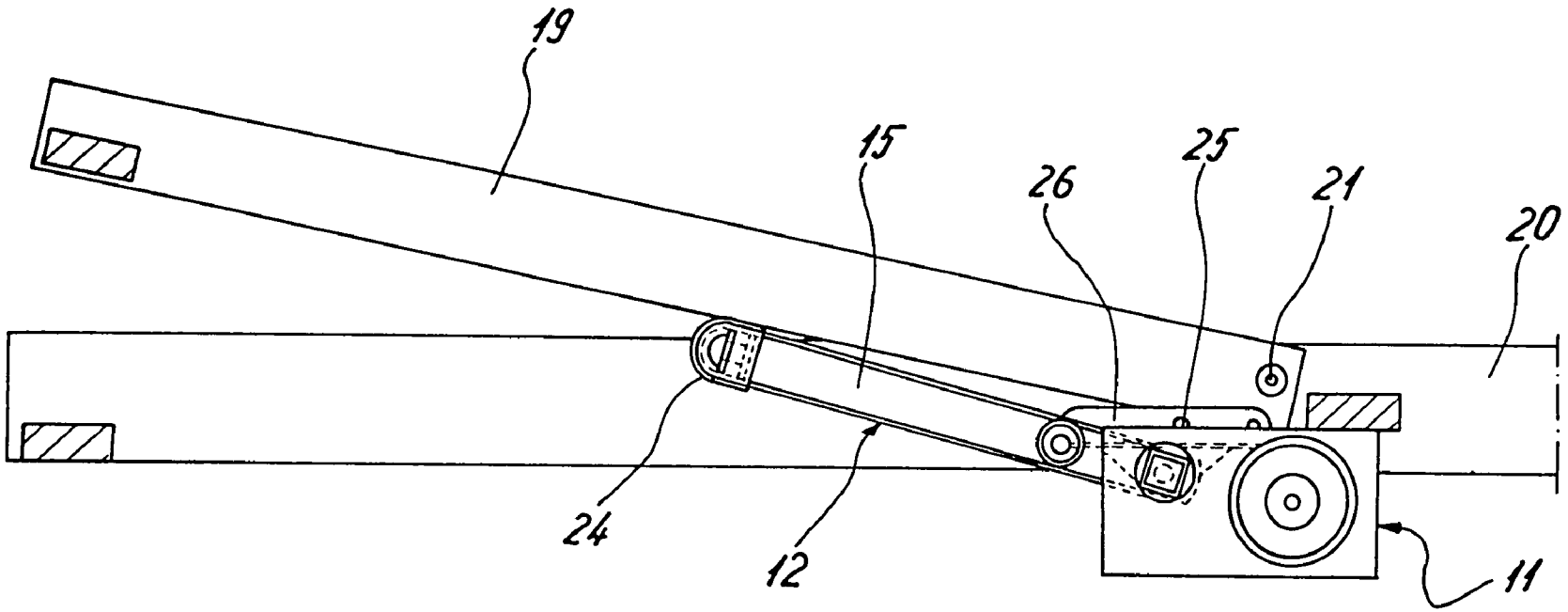
FIG. 7 is a schematic side view of the adjusting device of FIG. 6, showing the slatted frame in an intermediate position.
Figure 8:
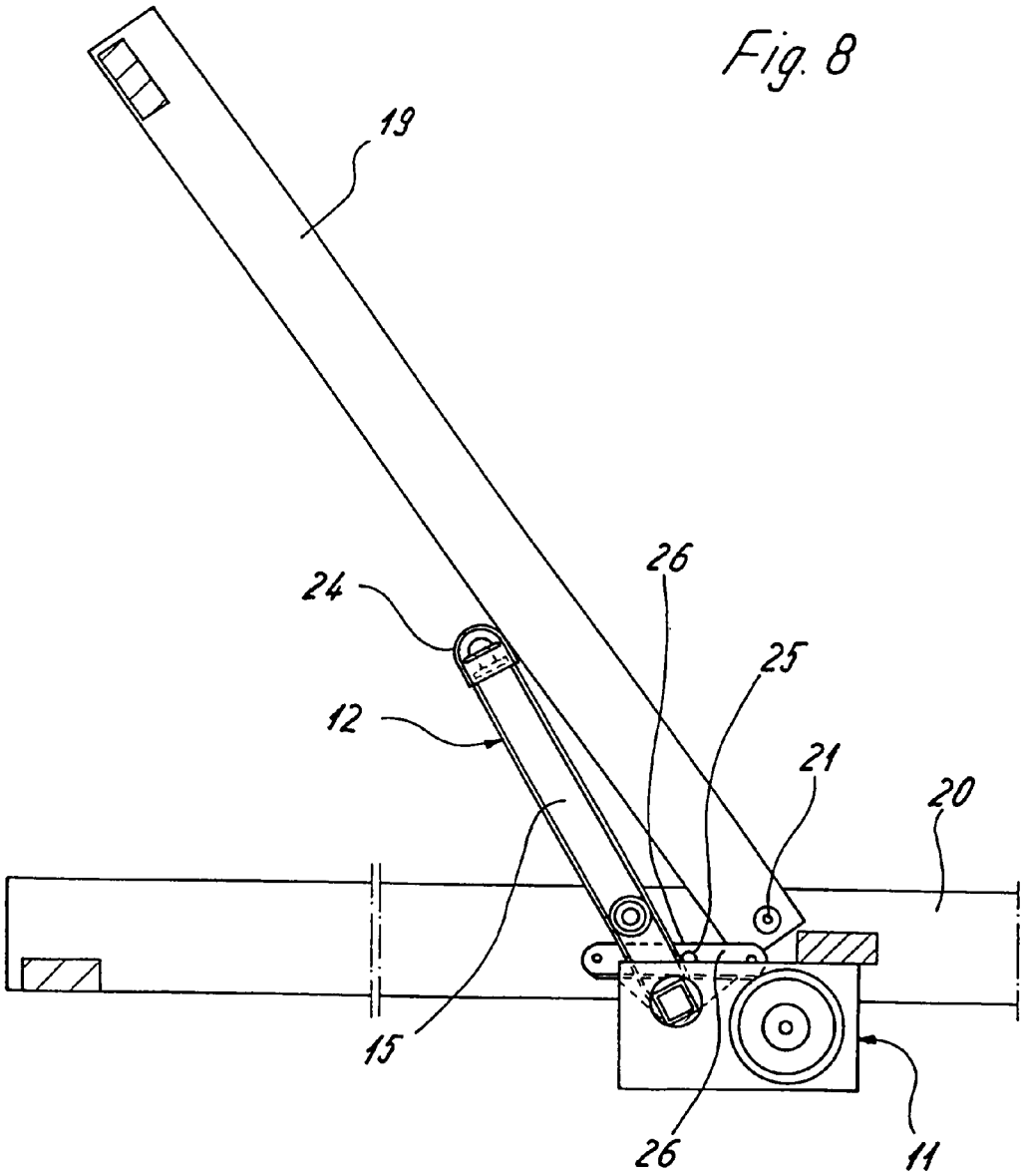
FIG. 8 is a schematic side view of the adjusting device of FIG. 6, showing the slatted frame in the other end position.

When the dc motor of the rotary drive mechanism 11 is activated, the horizontal lifting arms 15 are moved upwardly to thereby move the back portion 19 from the horizontal disposition, shown in FIG. 6, into an intermediate incline position, shown in FIG. 7, as the sliders 24 move along the side panels 20. Upon further swinging of the lifting arms 15 by the dc motor, the back portion 19 moves to the end position, as shown in FIG. 8. Lowering of the back portion 19 is implemented through reversing the rotation direction of the dc motor. The fully tilted end position of the back portion 19, as shown in FIG. 8 is defined by a stationary stop member 25 which is projects out from the mounting 26 to thereby secure the rotary drive mechanism 11 in proper place on one side panel 20 of the slatted frame 1, so that the lifting arm 15 impacts the stop member 25 when the back portion 19 reaches the end position. Of course, the stop member 25 may be secured also at a different location so that, for example, a side panel of the back portion 19 is intended to strike against the stop member. An attachment upon the housing 13 of the rotary drive mechanism 11 may also be conceivable.

The stationary stop member 25 is so operatively connected to the rotary drive mechanism 11 that the dc motor is cut as soon as the lifting arm 25 strikes against the stop member 25. In order to prevent a risk of damage, it is suitable to incorporate an overload relay as schematicaly shown in FIG. 1 in the power supply line (not shown) of the rotary drive mechanism. The overload relay opens the motor circuit when the current in the circuit is excessive and exceeds a preset value, thereby providing an overload protection. The provision of a stop member for restricting a movement of the back portion 19 is simple and cost-efficient. Of course, the use of limit switches is also conceivable. Also, the stop member 25 may be resilient so that the increase of current becomes smoother, thereby further protecting the rotary drive mechanism 11.

Figure 9:
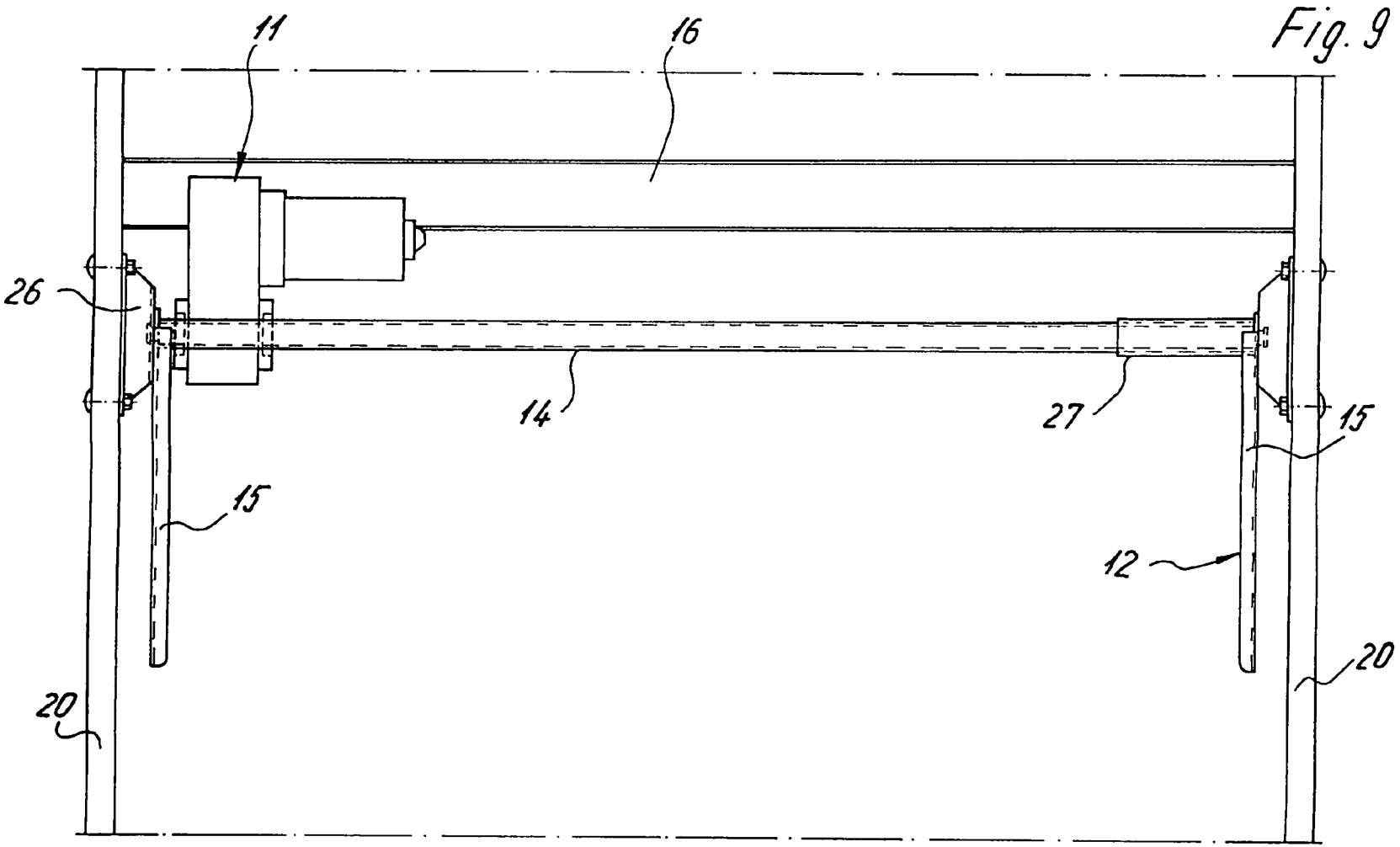
FIG. 9 is a top view of the adjusting device of FIG. 6.

As shown in FIG. 9, which is a top view of the adjusting device of FIG. 6, the crossbar 14 for interconnecting the lifting arms 15 is made of two parts and includes the actual crossbar 14 and a profiled piece 27. The rotary drive mechanism 11 is bolted via the mounting 26 to one side panel 20. To simplify the assembly, the profiled piece 27 is secured to the lifting arm 15, which is distal to the rotary drive mechanism 11, and points toward the rotary drive mechanism 11 for receiving the confronting end of the crossbar 14.

Figure 10:
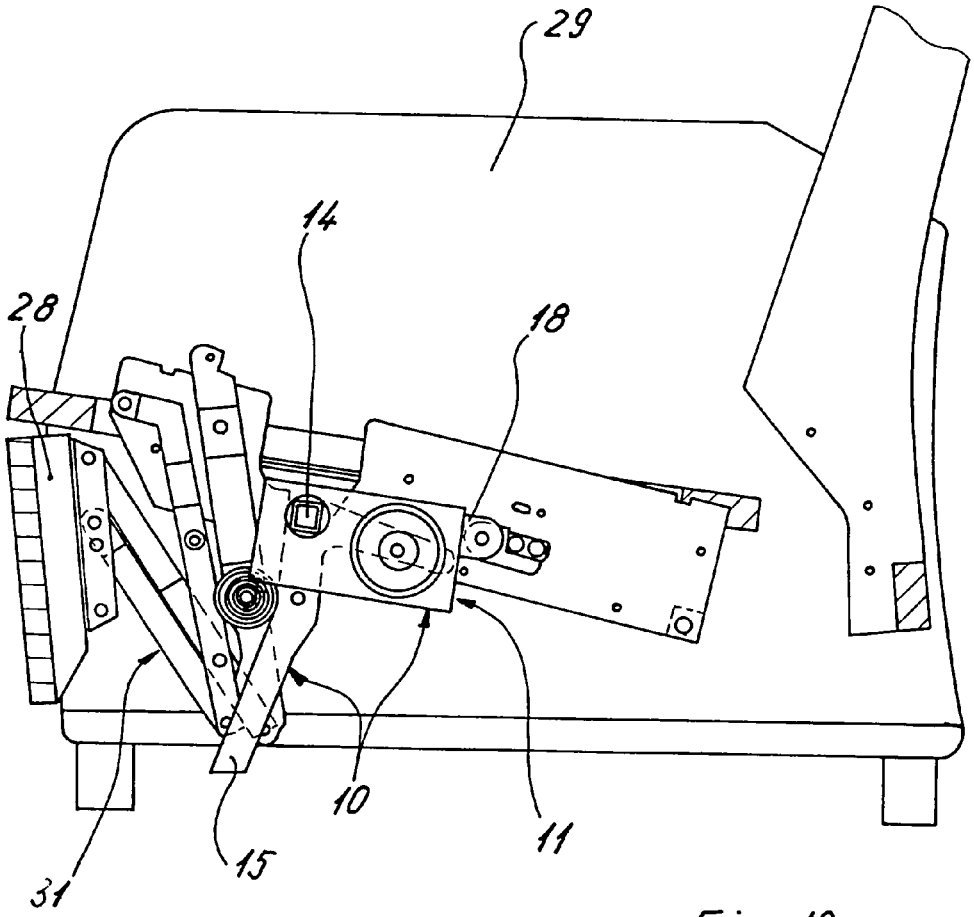
FIG. 10 is a schematic side view of yet another embodiment of an adjusting device according to the present invention, mounted to an exemplified chair for adjustment of a footrest, shown in stowed end position.
Figure 12:
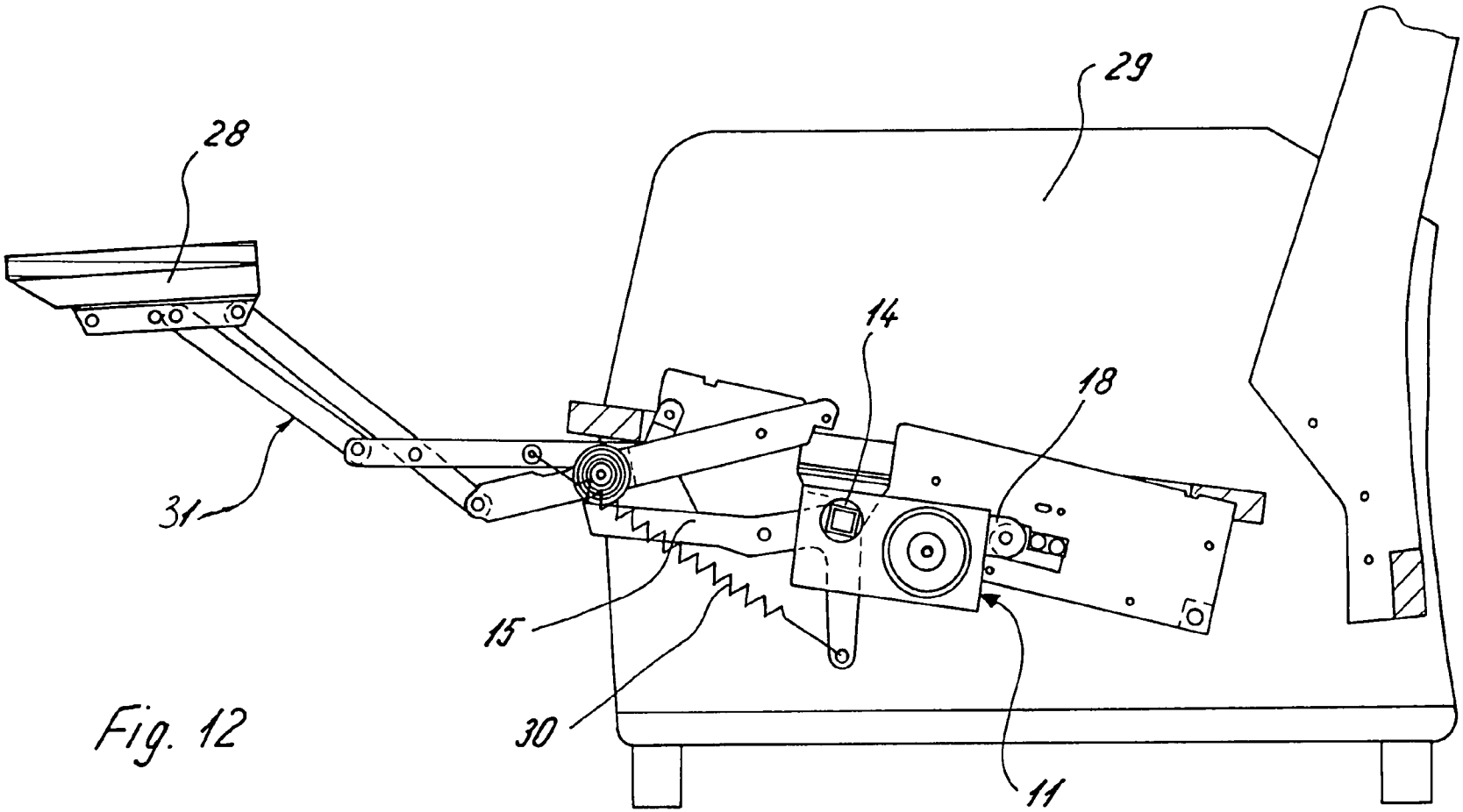
FIG. 12 is a schematic side view of the adjusting device of FIG. 10, showing the footrest in the other fully extended end position.

Turning now to FIG. 10, there is shown a schematic side view of yet another embodiment of an adjusting device according to the present invention, mounted to an exemplified chair 29 for adjustment of a footrest 28, shown in stowed end position. Parts corresponding with those in FIG. 1 are denoted by identical reference numerals and not explained again. In this embodiment, the lifting mechanism 12 is used to move the footrest 28 from the stowed end position to a fully extended shown in FIG. 12 and includes a pantograph linkage system 31 for implementing articulated movement of the footrest 28 between the stowed and extended positions. In general, the linkage system 31 is connected between the footrest 28 and the stationary frame of the chair 29 and includes a plurality of links interconnected in a manner generally known to the artisan and not described herein in more detail.

Persons skilled in the art will understand that the pantographic linkage system 31 is duplicated on the opposite side of the chair 29. For convenience, much of the description is made only in relation to one side of the chair, when in fact the two sides of the chair are mirror images of one another about an imaginary vertical medial plane which bisects the left from the right of the chair 29. The linkage system 31 is operatively connected to the lifting arms 15 (only one is visible here) which are secured in fixed rotative engagement on the crossbar 14 in a manner shown in FIG. 1, with the crossbar 14 guided through the output member of the rotary drive mechanism 11. The support of the rotary drive mechanism 11 is implemented here by a rod 32 which is received in aligned bores of the fork head 18 in a manner as shown in FIG. 3.

Figure 11:
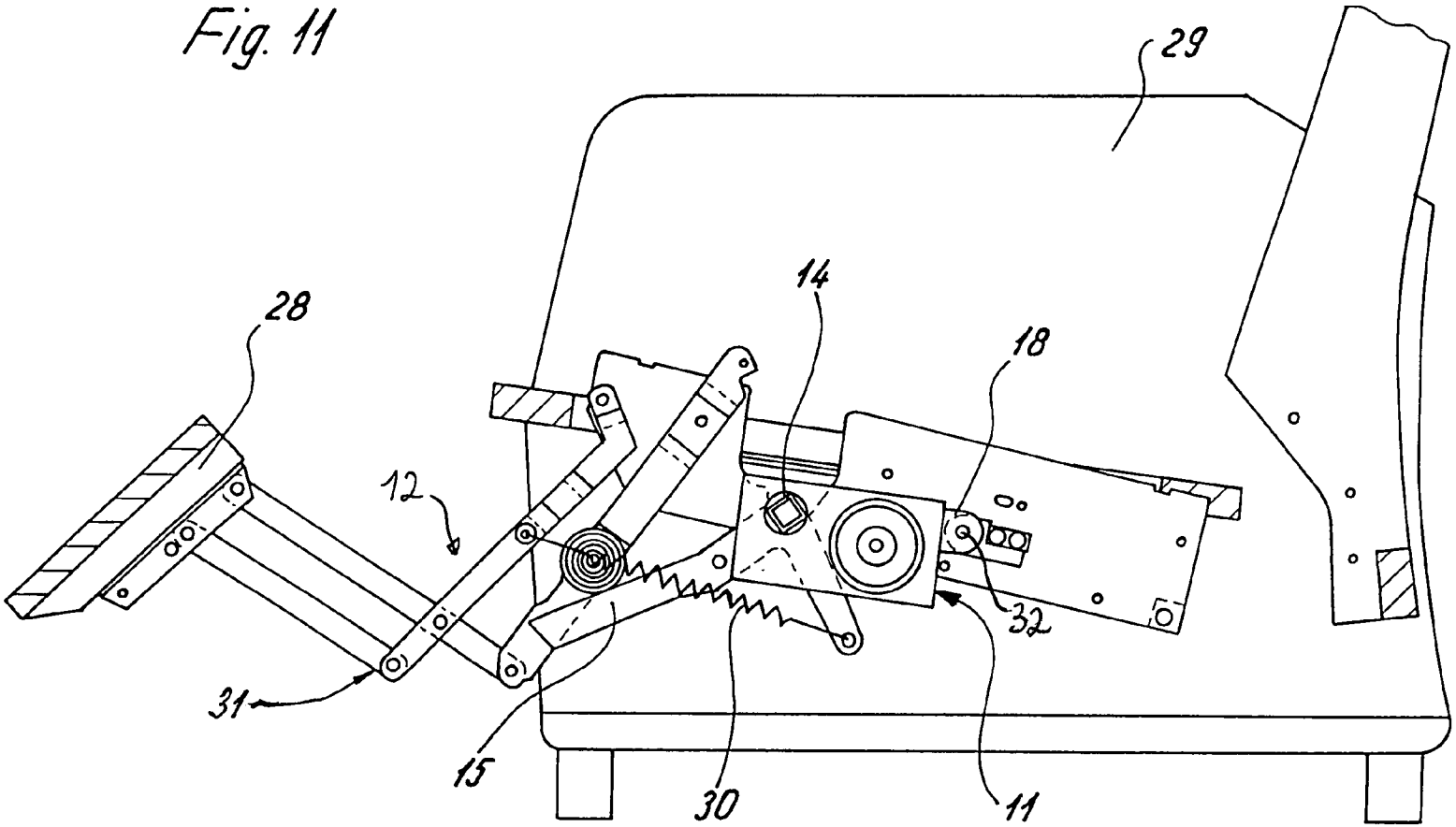
FIG. 11 is a schematic side view of the adjusting device of FIG. 10, showing the footrest in an intermediate position.

FIG. 10 shows the footrest 28 in the stowed position. When activating the rotary drive mechanism 11, the lifting arms 15 rotate in clockwise direction to move the linkage system 31 out and thereby move the footrest 28 via an intermediate position, shown in FIG. 11 to the fully extended position shown in FIG. 1. Return of the footrest 28 into the stowed position is implemented through reversal of the rotary drive mechanism 11, whereby a spring 30 assists the return movement of the footrest 28, with the spring 30 extending between a link of the linkage system 31 and the lifting arms 15.

While the invention has been illustrated and described as embodied in a adjusting device, it is not intended to be limited to the details shown since various modifications and structural changes may be made without departing in any way from the spirit of the present invention.

What is claimed as new and desired to be protected by Letters Patent is set forth in the appended claims.

What is claimed is:

1. Motion furniture comprising:

(1) a piece of seating furniture having a seat portion, a backrest portion, a stationary frame, and a movable footrest;

(2) an adjusting device for initiating movement of said footrest, wherein said adjusting device is (a) secured to a portion of said piece of said seating furniture and (b) comprises an electric rotary drive mechanism;

(3) a crossbar connected to said rotary drive mechanism and connected to said footrest, wherein said rotary drive mechanism directly rotates said crossbar, and (4) pantographic style linkage positioned between said footrest and a portion of said stationary frame of said seating furniture to facilitate movement of said footrest between a vertical stowed end position generally perpendicular to said seat portion of said seating furniture and a fully extended end position generally parallel to said seat portion of said seating furniture.

2. Motion furniture of claim 1, wherein said electric rotary drive mechanism comprises linkage.

3. Motion furniture of claim 1, wherein said crossbar is connected to said rotary drive mechanism by snug-fit passage of said crossbar through a polygonal bore in an output member of said rotary drive mechanism.

* * * * *